United States Patent [19]

Kock et al.

[11] Patent Number: 4,804,167

[45] Date of Patent: Feb. 14, 1989

[54] APPARATUS FOR MAKING NOBLE METAL/NON-NOBLE METAL COMPOSITE POWDER

[75] Inventors: Wulf Kock, Markdorf; Michael Laboureur, Constance, both of Fed. Rep. of Germany

[73] Assignee: Dornier System GmbH, Friedrichshafen, Fed. Rep. of Germany

[21] Appl. No.: 67,470

[22] Filed: Jun. 26, 1987

[30] Foreign Application Priority Data

Jul. 2, 1986 [DE] Fed. Rep. of Germany ..... 3622123

[51] Int. Cl.[4] ..... C22C 1/04

[52] U.S. Cl. ..... 266/200; 75/0.5 A; 75/0.5 BA; 75/0.5 C

[58] Field of Search ..... 266/200; 75/0.5 A, 0.5 BA, 75/0.5 CA

[56] References Cited

U.S. PATENT DOCUMENTS

| | | | |
|---|---|---|---|
| 3,901,492 | 8/1975 | Lafferty | 75/0.5 C |
| 4,396,420 | 8/1983 | Schmidberger et al. | 75/0.5 C |
| 4,594,101 | 6/1986 | Miura et al. | 75/0.5 C |
| 4,610,719 | 9/1986 | Wentzell | 75/0.5 C |
| 4,624,409 | 11/1986 | Takeda et al. | 75/0.5 C |
| 4,626,278 | 12/1986 | Kenney et al. | 75/0.5 BA |
| 4,689,075 | 8/1987 | Uda et al. | 75/0.5 BB |

*Primary Examiner*—Upendra Roy

*Attorney, Agent, or Firm*—Ralf H. Siegemund

[57] ABSTRACT

A compound powder being comprised of a noble metal and of a nonnoble metal oxide is produced under atomization of salts of these metals in a watery solution and under further utilization of a hot reactor wherein a droplet containing gas flow is moved inside the reactor by operation of a pressure differential produced by a water pump, the powder particles are gravity separated from reaction gases by gas flow reversal at a temperature above the dew point of the gas and the gas is scrubbed following condensation of any water vapor.

13 Claims, 1 Drawing Sheet

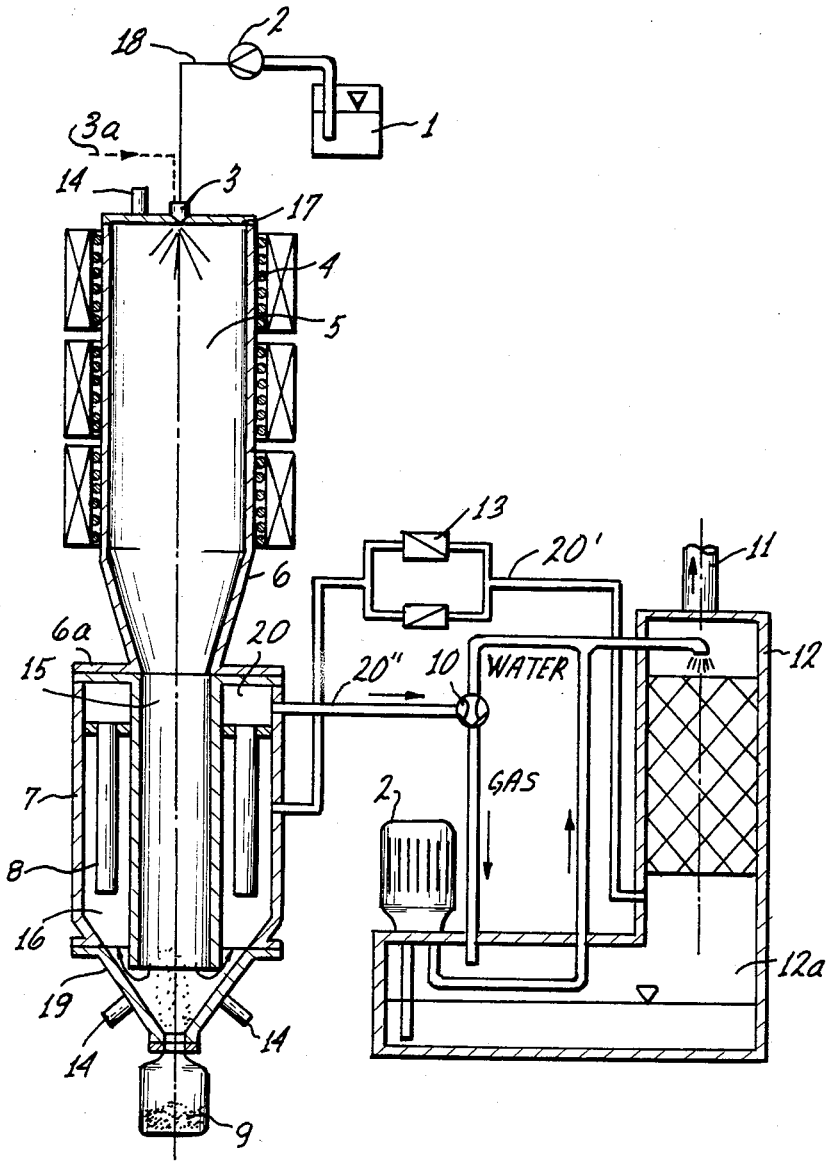
18
2
1
3a
14
3
17
4
5
13
20'
11
6
6a
20
15
20"
10
WATER
12
7
GAS
2
8
16
12a
19
14
14
9

APPARATUS FOR MAKING NOBLE METAL/NON-NOBLE METAL COMPOSITE POWDER

BACKGROUND OF THE INVENTION

The present invention relates to the making of compound powder and more particularly the invention relates to the manufacture of a compound powder or powder of a compositional material which includes a noble metal on one hand and a non-noble metal oxide on the other hand, under utilization of a watery (watery based) solution which includes salts of these metals and is atomized in a hot reactor.

German Pat. No. 29 29 630 discloses a method for the manufacture of a silver based powder, having in particular a composition of Ag and CdO. The powder is to be used for making electrical contacts. The powder itself is made by spraying (atomizing) a watery solution of silver salt and cadmium salt in a hot reactor, and the resulting powder particles, after the reaction has completed are separated from the hot gas in which they float, by means of a centrifugal precipitator which causes the separated metal particles to be collected. This particular approach is disadvantaged by the fact that the noble metal even for relatively low percentages in the non-noble metal oxide has the tendency to form a rather firmly adhesive coating, on the wall of the centrifuge resulting from the high relative speed between the powder particles and that wall.

DESCRIPTION OF THE INVENTION

It is an object of the present invention to provide a new and improved method and equipment for the making of compound powder including a noble metal and a non-noble metal oxide under utilization of atomization but avoiding the disadvantages outlined above and avoiding particularly high speeds of a pulverladen gas so as to avoid coating of the centrifuge and/or any other collection chamber with a firmly adhering product coating.

Therefore it is a particular object of the present invention to provide a new and improved method and equipment for the making of compound powder that includes a noble metal as well as a non-noble metal oxide by atomizing a watery solution of salts of the metals and within a hot reactor.

It is another object of the invention to provide a new and improved method and equipment for preparing material for subsequent making electrical contacts with good arc extinguishing capabilities, little propensity towards welding and very little burn-off.

It is suggested to provide atomization in a hot reaction chamber with or without a host or carrier gas, a gaseous atmosphere, but the differential pressure between the exterior and the interior of the reactor kept at a low level, the separation of the compound powder particles is carried out by means of a hot gas filter operating above the dew point of the reactor chamber gas, the gas is purged out of the filter by means of a water jet pump whereby the powder particles separate from the gas basically by the force of gravity followed by cleaning and scrubbing of the gas, particularly after condensation of any water vapor.

The solution is first atomized by either means of a single material nozzle or a two component nozzle resulting in either case in a medium droplet diameter of about 40 micrometers. A one component nozzle is prepared for reasons of simplification. Here then the gas pressure in the chamber results exclusively from internal decomposition. Two component nozzles have the advantage of a fine atomization i.e. smaller sizes in the particle distribution. The pressure for the atomization is preferably removed through an oscillating displacement pump and cooperates with an attenuator. Alternatively atomization obtains through pressurized gas cushion or possibly in conjunction with two component nozzle. The reactor chamber is constructed so that the powder particles will reach the capturing container with the aid of gravity. The pressure and the reactive chamber should be limited as far as the pressure differentials are concerned to +10 mbars. The temperature of the wall in the hot gas filter should be maintained within a 100 and 400 degrees C. and the gas flow passes a sedimentation chamber without deflection but is downstream deflected from by 180 degrees through a toroidal exit chamber. The filter should be made of metal felt, sinter metal or a porous ceramic. The scrubber may also be a tower with cirulating water operating at low pressure loss in the gas so as to keep the overall pressure differential in the system low.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates somewhat schematically a cross section through equipment constructed in accordance with the preferred embodiment of the present invention for practicing the best mode thereof.

Proceeding to the detailed description of the drawings the figure shows a reactor with a gas tightly sealed reactor chamber 5 arranged in a frame, housing or the like which is not shown. The chamber 5 is basically of tubular construction and is open at the top but there is a cover 17 for sealing the interior of the reactor chamber 5. An atomizing nozzle 3 is disposed in the center of the cover or lid 17 which nozzle is connected to a conduit 18 leading from a pump 2 by means of which a watery suspension or solution is pumped from a container 1. The pump 2 is preferably an oscillating or pulsating displacement pump combined with an oscillation attenuator. The container holds a particular watery solution of a silver salt and of salt of a non-noble metal. A particular example of preparing such a product to be atomized is disclosed in copending application U.S. Ser. No. 07/067,469 filed 06/26/1987 of common assignee with overlapping inventive entity involving specifically the making of a suspension type salt solution of tin and silver for making a tin oxide and silver powder.

Lid or cover 17 carries electromagnetically actuated hammers or impact devices 14 which upon triggering cause any precipitated powder particles to be removed and to drop off the walls of chamber 5 as well as the inner wall surface of cover 17. The reaction chamber as well as the cover or lid 17 are made of a alloy which has a high hot strength. The upper portion of the reaction chamber is surrounded by an electric heating device such as a coil 4. The atomizing nozzle is cooled and the dash dot arrow 3*a* schematically indicates the cooling process, for example by means of a water flow. In order to compensate differential pressure between the interior of the chamber 5 and the outer atmosphere pressure compensating flaps and check valves 13 are provided.

The reaction chamber 5 has a lower tapered portion 6 with a flange *6a*, and a hot gas filter chamber 7 is flanged, welded bolted or the like to that flange *6a*. The interior of the hot gas filter chamber 7 contains a sedimentation chamber 15 and filter elements 8 on the outside but inside chamber 16. The lower portion of the filter 7 is connected to a conical collection chamber or funnel 19 also having lateral impact devices 14. These hammers 14 have the same function as the one mentioned above on lid 17. The lower end of sedimentation chamber 15 is open and dips into funnel 19 which thus establishes a gas return (upflow) path. The narrow end of conical chamber 19 is provided with an opening 19*a* to which is connected a flask, bottle, collector, container 9 or the like.

An annular collector or manifolding chamber 20' is provided above chamber 16 for capturing the gas that has passed through the bottom opening of the tubular sedimentation chamber 15 and through the filtering elements 8. The main part of the gas that has passed through filters 18 into the upper annular (toroidal) collection chamber 20 flows through a conduit system 20'' to a water jet pump 10. The pump 10 feeds the gas to a gas scrubber 12 for discharge (11) into the atmosphere. The flow path 20' leads from the return path chamber 16 via check valves 13 or other differential selective means to the "dirt gas" plenum 12*a* of scrubber 12. This renders available a sufficient gas volume space for pressure equalization such that the differential in the space between the reaction chamber and the outer atmosphere remains within narrow limits.

The filter elements 8 may be made of a sinter metal, metal felt (fibrous metal mesh) or a porous ceramic. The pump 10 is either water jet pump with a closed circuit which includes the moist exhaust gas flow and operates above the dew point, or one may use an air-pressurized ejection or one may use the excess pressure produced on evaporation of the spray solution in the reaction chamber. All these are available sources for, basically, moving the reaction gas out of the reaction chamber and through the scrubber.

Turning now to some details with regard to the processing it is pointed out that atomizing a watery solution requires on one hand that the droplets produced are fine i.e. the spectrum and size distribution for the droplets should be such that the bulk of the distribution and median values are in the micrometer range so that there is an adequate large ratio between surface and volume of the droplets permitting the solvent to evaporate rapidly and to provide for maximum surface area exposing the material to the hot reactor atmosphere. On the other hand the solution must not be heated unduly in the nozzle or in the conduits which is the reason for the water cooling of the nozzle. This is so, since several types of salts become less solvable in water at higher temperatures through the so called hydrolysis effect and exhibit precipitation from a concentrated solution. Boiling of the solution to be atomized is to be avoided under all circumstances, since such a resulting two phase flow will plug or clog the nozzle. The maximum exit speed of the flow as it emerges from the nozzle occurs is the speed of sound and is lower for a two phase flow than for each phase separate. Moreover the mass flow of the gaseous portion in the two phase flow is by about 3 orders of magnitude smaller than a similar volume or quantity of liquid. Another aspect is that the atomization will have its surfaces at a temperature above the dew point. This is true with regard to all surfaces engaging the reactor atmosphere. This particular requirement involves specifically all surfaces which for some reason may be exposed to the fog of droplets being produced. These surfaces must have a temperature which is so high that any droplets that hit them will bounce off owing to the so called Leidenfrost effect. This effect involves the formation of a vapor layer between the liquid droplet and a hot surface which layer avoids wetting of that surface.

The atomizing nozzle may be single material or two material nozzles. A single material or compound nozzle when used has the advantage that no particular atomizing (carrier) medium such as air or the like is needed; thus any increase in the flow speed in the reactor 2 will not occur on account of such a carrier gas. Also a single material nozzle does not reduce the residence time of any powder particle in the hot reactor zone of chamber 5. Using a single component nozzle also avoids any residual or supplemental problems regarding gas composition and speed in the scrubber 12. Two component nozzles have the advantage that therefore as per the present invention a droplets they produce are finer. Or the product may be of higher quality which is traded off by some greater complication in the equipment. This is an economic aspect and of no immediate concern regarding the technological aspects.

A typical feature of a noble metal containing powder having a relatively low content in non-noble metal oxide is the tendency mentioned earlier to adhere to an equipment wall. The equipment as described avoids this disadvantage by the avoidance of the centrifugal precipitation and a low flow speeds under strict avoidance of directional changes in droplet laden gas flows at least to the utmost extend possible. It is decisive that this condition and aspect is realized in the area of separating the particles from the gas flow. As stated earlier conventional precipitators are of compact design and provide for good separation at high speed and acceleration to throw the droplets out of the gas flow. Aside from any clogging the throwing of droplets against any wall and adhering thereto is the main problem. The inventive equipment avoids this coating formation owing to the sedimentation chamber 15 wherein the deflection of the flow of gas from down to up at the bottom outlet of tube 15 occurs at a speed that is below the Stokes speed of droplet descent. For this reason the droplets will fall into the funnel. Any residual content in noble metal particles will be captured by the filter element 18.

Filter elements 18 may preferably be constructed as sintered metal felt as a preferred form. Ceramic filter are suitable too but they have a tendency to provide impurities to the powder. Metal felt exhibit low pressure losses even in the case of rather high powder loading. They also can be cleaned easily through a reversing air pressure pulse that may be introduced automatically in dependence upon any observed pressure loss owing to the beginning of filter clogging. Ease of cleaning is very important in the case of a metallic reactor chamber. A small gas volume for the cleaning gas and pressure pulse changes the pressure conditions in the reactor to an insignificant degree so that the wall of the chamber can be made quite thin and does not have to be reinforced.

The location of powder separation in the funnel 19 which generally is an area in which the tendency may be developed to accumulate powder on the walls. For this reason the impacting devices 14 are provided at this funnel 19 in order to loosen any powder particle that may adhere. Another area that is in danger of becoming coated with adhering powder particles is the upper wall of chamber 15 where the nozzle cone intersect this wall. The movement of the particles is enhanced in the direction of the wall by convection owing to the thermal condition in the nozzle area. On the other hand any deposit in the intersection can be removed mechanically such as scraping or impacting devices or eccentric devices which are motor driven or the like. The particular impact devices or hammers 14 in the cover 17 are sufficient.

For reasons of economy there is a need not to waste material and to make the various parts including the reactor chamber of thin metal sheet. The pressure differential between the interior and the exterior should not exceed certain limits. High temperatures have also the effect of reducing the strength of material and since temperatures of about 1000 degrees C. have to be expected the pressure differential has to remain low. Such pressure differential could occur if under predetermined conditions the rate of gas development in chamber 5 remains constant while changes in the flow speed on account of filter modifications reduces the amount of gas that is extracted from the chamber so that the chamber pressure will increase! It is also a particular problem that certain conduits may change effective cross sections so that pressure changes occur on the account within the system. The flow may even stop entirely. Exceeding the maximal rated pressure in the system sudden pressure deviations have to be avoided particularly those kinds of pressure changes which are difficult to control as far as throughput and differential pressure production is concerned. This is a feature which should be operative throughout so as to avoid pressure changes which the control may not be able to take up. In order to avoid interference with the gas scrubbing any pressure compensation should not be carried out directly by dumping excess gas into the outer atmosphere, but the pressure compensation has to occur through some form of reservoir which is off the outer atmosphere but has atmospheric pressure and is free from any of the gases that circulate in the system. If the gas scrubber operates with a low pressure loss then its volume meets these requirements.

The gas scrubber 12 is provided in order to clean the process and exhaust gases from chamber 20. In the case of silver as a noble metal one will practically always use as a starting product silver nitrate. On account of the properties of silver ions this kind of compound is free of Cl. This means that the gas scrubber can be made of Cr-Ni steel. In the case of a thermal decomposition of nitrates such NO is produced and one has to consider that this oxide is not very well soluble in water and, therefore, will be scrubbed out of the exhaust gas only to a very insignificant degree. This problem can be solved as follows. (a) The decomposition of the salt occurs in a completely enclosed reactor; (b) the nitrate decomposition produces stoichiometric amounts of NOX and $NO_2$ which at low temperatures recombine to water soluble $NO_2$. (c) The gas also contains water vapor which can be removed through condensation. No other contaminant occurs in the gas. Hence only NO and $NO_2$ will enter the scrubber with a little water vapor in addition.

During the residence time of this gas $NO_2$ will be absorbed in the scrubbing liquid whereby 3 mols $NO_2$ produce 2 mols $HNO_3$ and one mol NO. This means that the volume flow and therefore the flow speed which in each of the absorption stages is reduced accordingly. A limit for the flow speed of the exhaust gases for complete or nearly complete absorption actually=0. This means that no exhaust gas will leave the discharge point of the scrubber. Any amounts of NO that have in fact a dwell time of nearly (theoretically) infinity has thus a sufficiently long residence time for oxidation. Decisive is that the absorption is a second order effect as far as NO concentration is concerned and, therefore, slows down in the presence of foreign gases owing to the drop in concentration pursuant to the scrubbing! Tests have shown that the concentration of the NO does not change in exclusive presence of the decomposition products of nitrate. The conversion rate up to the complete oxidation of NO remains constant.

There are cases in which technical requirements require a two component nozzle so that a large amount of air is needed for cleaning the filters or one has to remove noncondensible gases such as $CO_2$ which came about through from the auxiliary material needed for the initial preparation of the solution. Therefore if an undue a large amount of gas leaves the scrubber the dwell time is no longer sufficient for the complete removal of NO. Here then gas cleaning can be carried out differently. The core of this modified process is the addition of $NO_2$ or one of its predecessors such as gaseous $HNO_3$ which is water soluble and continues the reaction with NO to form $HNO_2$. The presence of another oxidation medium such as $H_2O_2$ causes the reaction rapidly to continue to form $HNO_3$. In fact, one can acquire $HNO_3$ at considerable concentration. $HNO_3$ therefore can now be used as a partial product for enriching the exhaust gas with an optimum amount of $NO_2$ depending in the degree of oxidation in the exhaust gas. The bulk $HNO_3$ may be used for solving the compound to be atomized. (see the copending application U.S. Ser. No. 07/067,467 filed 06/26/1987 for use of $HNO_3$ in the preparation of the liquid to be atomized) It is of advantage that the captured amount of $HNO_3$ is that quantity that is necessary for obtaining the requisite solutions. No problem will exist regarding contaminant removal for the compound production.

The invention is not limited to the embodiments described above but all changes and modifications thereof, not constituting departures from the spirit and scope of the invention, are intended to be included.

We claim:

1. Apparatus for providing composite powder particles comprising:

a heated reaction chamber with nozzle means for atomizing a liquid and spraying droplets into the chamber for gas producing reaction and droplet descent;

a hot gas filter with central descent tube, return flow path, filter elements and flow deflection means as well as a collection chamber at the bottom of the filter, the central descent tube being connected to the bottom of the reaction chamber;

a scrubber having an inlet plenum connected (a) to the flow discharge means and (b) to the return flow path via pressure responsive means for limiting the gas pressure in said filter and said reactor chamber using said plenum for equalization.

2. Apparatus as in claim 1, including hammer means on the chamber for loosening any internal deposits.

3. Apparatus as in claim 1, said flow discharge means being a toroidal chamber.

4. Apparatus as in claim 1, said return path being a toroidal chamber containing the filter element.

5. Apparatus as in claim 1, said collection means being a funnel underneath said tube.

6. Apparatus as in claim 1, said filter elements being made of metal felt, sinter metal or porous ceramic.

7. Apparatus as in claim 1, the nozzle means being a one component nozzle.

8. Apparatus as in claim 1 the nozzle means being a two component nozzle.

9. In an apparatus for the production of composite powder being comprised of a noble metal and of a non-noble metal oxide under atomization of salts of these metals in watery solution and under further utilization of a hot reactor, the improvement comprising:

means for atomizing the metal solution;

means including a water pump for moving a droplet containing gas flow inside the reactor by operation of a pressure differential produced by the water pump, the gas resulting at least in parts from reaction in the reactor beyond a closed chamber reactor;

flow deflection means for separating the powder particles from reaction gases at a temperature above the dew point of the gas; and means for scrubbing the gas in a scrubber following condensation of any water vapor.

10. Apparatus as in claim 9, the means for atomizing being a single component nozzle for producing medium droplet dimension of about 40 micrometers.

11. Apparatus as in claim 9, said pump being an oscillatory displacement pump and includes pulsation attenuation.

12. Apparatus as in claim 9, including means for providing a pressurized gas cushion for liquid being atomized.

13. Method as in claim 9, including means for limiting the pressure differential to 10 millibars.

* * * * *